United States Patent [19]

Bland et al.

[11] 4,403,972

[45] Sep. 13, 1983

[54] MARINE PROPULSION DEVICE INCLUDING ENGINE HOUSING PUMP MECHANISM

[75] Inventors: Gerald F. Bland; Allen N. Ladwig, both of Kenosha, Wis.

[73] Assignee: Outboard Marine Corporation, Waukegan, Ill.

[21] Appl. No.: 365,616

[22] Filed: Apr. 5, 1982

[51] Int. Cl.[3] ..... B63H 5/12

[52] U.S. Cl. ..... 440/88

[58] Field of Search ..... 440/88, 89, 900; 114/183 R; 123/41.08

[56] References Cited

U.S. PATENT DOCUMENTS

| | | | |
|---|---|---|---|
| 2,151,225 | 3/1939 | Newton | 440/900 |
| 2,604,867 | 7/1952 | Frye | 440/88 |
| 2,627,242 | 2/1953 | Kiekhaefer | 440/89 |
| 2,903,991 | 9/1959 | Carlson et al. | 440/88 |
| 3,025,824 | 3/1962 | Foster | 440/88 |

*Primary Examiner*—Trygve M. Blix
*Assistant Examiner*—Jesus D. Sotelo
*Attorney, Agent, or Firm*—Robert E. Clemency

[57] ABSTRACT

A marine propulsion device is disclosed as including a housing surrounding an engine and including a sump which may collect water. A siphon conduit is provided for removing water from the sump, the siphon conduit including an inlet end housed in the sump and a discharge end projecting from the housing for discharging water from the sump. Another conduit is connected to the siphon conduit and for generating water flow through the siphon conduit from the sump and toward the siphon conduit discharge end, this second conduit being connected to the engine water pump and adapted to force a jet of water into the siphon conduit and toward the discharge end of the siphon conduit.

9 Claims, 3 Drawing Figures

MARINE PROPULSION DEVICE INCLUDING ENGINE HOUSING PUMP MECHANISM

FIELD OF THE INVENTION

The invention relates to marine propulsion devices and more particularly to means for pumping water out of the engine compartment of an outboard motor and the like.

BACKGROUND PRIOR ART

Examples of prior art pumping apparatus are illustrated in the Brear U.S. Pat. No. 49,602, issued Aug. 29, 1865; the Von Lindenstamm U.S. Pat. No. 842,100, issued Jan. 22, 1907; the Aaron U.S. Pat. No. 952,292, issued Mar. 15, 1910; the Gram U.S. Pat. No. 1,162,223, issued Nov. 30, 1915; the Good U.S. Pat. No. 1,304,961, issued May 27, 1919; and the Gastell U.S. Pat. No. 1,729,577, issued Sept. 24, 1929.

Attention is further directed to Aaron U.S. Pat. No. 1,856,367, issued May 3, 1932; the Gavaza U.S. Pat. No. 1,963,522, issued June 19, 1934; the Sawyer et al U.S. Pat. No. 2,479,783, issued Aug. 23, 1949; the Lee U.S. Pat. No. 2,551,497, issued May 1, 1951; the Frye U.S. Pat. No. 2,604,867, issued July 29, 1952; and the Kiekhaefer U.S. Pat. No. 3,627,242, issued Feb. 3, 1953.

Attention is also directed to the Winkelman et al U.S. Pat. No. 2,733,679, issued Feb. 7, 1956; the Carlson et al U.S. Pat. No. 2,903,991, issued Sept. 15, 1959; the Roulund U.S. Pat. No. 3,273,333, issued Sept. 20, 1966; the Wilkerson U.S. Pat. No. 3,870,008, issued Mar. 11, 1975 and the Belsky U.S. Pat. No. 3,946,694, issued Mar. 30, 1976.

SUMMARY OF THE INVENTION

The invention includes a marine propulsion device having an engine including cooling passages and a water pump for forcing cooling water through the cooling passages to cool the engine, a lower unit extending downwardly from the engine, a propeller supported by the lower unit and rotatably driven by the engine, and a housing surrounding the engine and including a portion defining a chamber which may collect water. The marine propulsion device also includes siphon means for removing water from the chamber, the siphon means including a siphon conduit having an inlet end positioned in the chamber, and a discharge end projecting from the engine housing for discharging water from the chamber. Means are also provided or generating water flow through the siphon conduit from the inlet end and toward the discharge end, the means for generating water flow including means connected to the water pump for forcing water into the siphon conduit and toward the discharge end.

The invention further includes a marine propulsion device having an engine including cooling passages and a water pump for forcing cooling water through the cooling passages to cool the engine, a lower unit extending downwardly from the engine, a propeller supported by the lower unit and rotatably driven by the engine, and a housing surrounding the engine and including a portion defining a chamber which may collect water. The marine propulsion device also includes siphon means for removing water from the chamber, the siphon means including a siphon conduit having a first conduit portion, the first conduit portion having an upper end and a lower end housed in the chamber, and a second conduit portion having an upper end and a lower end, the upper ends of the first and second vertical conduit portions being joined, and the lower end of the second conduit portion projecting from the housing for discharging water from the chamber. Means are also provided for generating water flow through the siphon conduit from the chamber and toward the second conduit portion lower end, the means for generating water flow including means connected to the water pump for forcing water into the siphon conduit and toward the second conduit portion lower end.

In one embodiment of the invention the water pump includes an outlet port connected to the cooling passages, and the means for generating water flow through the siphon conduit includes a supply conduit including opposite ends, one end of the supply conduit being connected to the cooling passages and the other end of the supply conduit being connected to the siphon conduit so as to force water into the siphon conduit toward the discharge end.

In a preferred embodiment of the invention, the end of the supply conduit joined to the siphon conduit intersects the second circuit portion at an acute angle and forces water downwardly into the second siphon portion in the direction of the discharge end of the siphon conduit.

The invention also includes a marine propulsion device having an engine including cooling passages and a water pump for forcing cooling water through the cooling passages to cool the engine. The marine propulsin device also includes a lower unit extending downwardly from the engine, a propeller supported by the lower unit and rotatably driven by the engine, and a housing surrounding the engine and including a portion defining a chamber which may collect water. Means are also provided for bleeding water from the cooling passages and for discharging water from the engine so as to provide a signal that the water pump is operating, the means for bleeding including a bleed conduit having one end connected to the cooling passages and an opposite end outside the engine housing. A siphon means is also provided for removing water from the chamber, the siphon means including a siphon conduit having an inlet end positioned in the chamber, and the siphon conduit being connected to the bleed conduit.

Various other features and advantages of the invention will be apparent by reference to the following description of a preferred embodiment, to the claims, and to the drawings.

Figure 1:
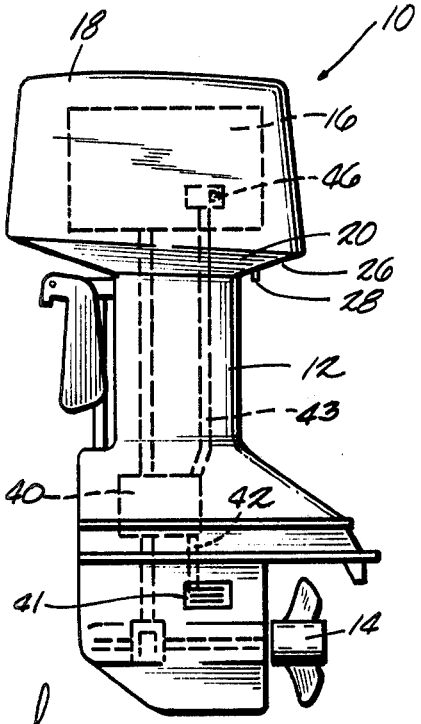
FIG. 1 is a side elevation view of an outboard motor embodying the invention.

Before explaining the invention in detail, it is to be understood that the invention is not limited in its application to the details of construction and to the arrangement of the components set forth in the following description or illustrated in the drawings. The invention is capable of other embodiments and of being practiced and carried out in various ways. Also it is to be understood that the phraseology and terminology employed herein are for the purposes of description and should not be regarded as limiting.

DESCRIPTION OF A PREFERRED EMBODIMENT

Figure 2:
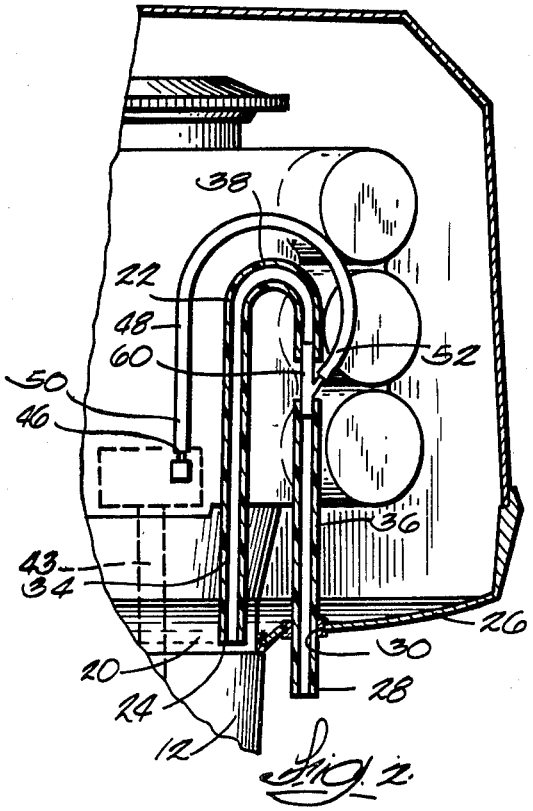
FIG. 2 is an enlarged cross section view of a portion of the outboard motor illustrated in FIG. 1.
Figure 3:
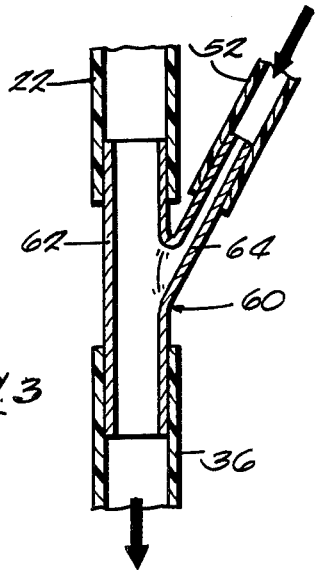
FIG. 3 is an enlarged view of a portion of the structure illustrated in FIG. 2.

Illustrated in FIG. 1 is a marine propulsion device in the form of an outboard motor 10 including a lower propulsion unit 12 supporting a propeller 14. The outboard motor 10 also includes an internal combustion engine 16 drivingly connected to the propeller 14 for rotatably driving the propeller. The engine 16 is surrounded by a housing or engine cover 18, the housing 18 including a lower portion defining a sump or chamber 20 which may collect water, as illustrated in FIG. 2, during operation of the motor 10 under extreme operating conditions.

Means are further provided for removing this water from the sump 20 and for discharging the water overboard. The means for removing water from the sump 20 includes a siphon arrangement comprised of a siphon conduit 22 (FIG. 2) having an intake end 24 positioned in the sump 20 and adjacent to the bottom wall 26 of the engine housing 18 and an opposite or discharge end 28 extending through an opening 30 in the bottom wall 26 of the housing 18 and so as to discharge water flowing through the siphon conduit 22 from the sump 20. While the siphon conduit 22 could have other constructions, in the illustrated arrangement the siphon conduit 22 is shown as having an inverted U-shape and includes a first or upwardly extending portion 34, the lower end of that upwardly extending portion 34 comprising the intake end 24 of the siphon conduit. The siphon conduit 22 also includes a downwardly extending portion 36 joined at its upper end by a curved connecting portion 38 to the upwardly extending portion 34 of the siphon conduit. The lower end of the downwardly extending siphon portion 36 defines the discharge end 28 and projects through the opening 30 in the bottom wall 26 of the housing 18 to permit discharge of water from the sump 20. While the siphon conduit 22 could have other constructions, in a preferred embodiment, the discharge end 28 of the siphon conduit 22 is positioned below the intake end 24.

In operation of the siphon conduit 22, if the discharge end 28 of the siphon conduit is positioned below the intake end 24, once the siphon conduit is filled with fluid and flow through the conduit is established, gravitational forces on the fluid in the siphon conduit will cause the fluid flow to continue.

While the siphon conduit 22 could have other constructions, by providing the inverted U-shape arrangement illustrated, water can be siphoned from the engine housing, but water splashing up under the engine due to wave action and the like will not enter the engine housing.

Means are also provided for initiating the flow of water through the siphon conduit 22 and for assisting in maintenance of the flow of water through the siphon conduit once it has been initiated. This means for initating flow through the siphon conduit 22 comprises means connected to the water pump 40 of the outboard motor 10 and for forcing a jet of water through the siphon conduit 22 in the direction of the discharge end 28 of the conduit. In the illustrated construction, a water pump 40 is housed in the lower propulsion unit 12 and water is supplied to the water pump through an inlet 41 and a conduit 42. The water pump 40 forces water through a conduit 43 to the cooling passages of the engine 16. The means for initiating flow through the siphon conduit also includes a supply conduit or tube 48 connected to the cooling passages by a tap 46.

The supply conduit 48 connected to the tap 46 of the water pump 40 includes opposite ends, one end 50 connected to the tap 46 and an opposite end 52 connected to the second vertical portion 36 intermediate its opposite ends. The supply conduit 48 is joined to the siphon conduit 22 such that water flowing through the supply conduit 48 is discharged in the form of a jet into the siphon conduit 22 and with the jet being directed toward the discharge end 28 of the siphon conduit.

In the illustrated construction the end 52 of the supply conduit 48 is connected to the siphon conduit 22 by means of an angled tee 60. The tee 60 includes a linear portion 62 inserted into a portion of the siphon conduit 22 and a nozzle portion 64 integrally joined to the linear portion 62 at an acute angle. More particularly, the nozzle portion 64 is arranged so as to cause the water flowing through the supply conduit 48 and into the siphon conduit 22 to enter the siphon conduit at an acute angle of approximately 30 degrees and toward the discharge end 28. This flow of water through the downstream end or discharge end of the siphon conduit functions to generate a suction in the upstream portion of the siphon conduit thereby tending to draw water in the sump 20 up into the inlet end of siphon conduit. Once the siphon conduit 22 fills with water, the siphon effect causes water to flow through the siphon conduit and to be discharged from the sump 20.

The continued flow of water from the water pump 40 and through the supply conduit 48 into the siphon conduit 22 also functions as a means for augmenting or increasing the flow of water through the siphon conduit in the manner of a jet pump. More particularly, even after the siphon effect has been established, the jet of water from the nozzle 64 and into the downstream end of the siphon conduit 22 generates a suction on the upstream portion of the siphon conduit and tends to increase the rate of flow of water through the siphon conduit. The siphon conduit 22 thus functions as a result of the combination of a siphon effect due to the relative positions of the intake and discharge ends of the siphon conduit and due to the jet pump effect provided by the water forced into the downstream end of the siphon circuit.

One of the advantages of the arrangement described above is that the siphon arrangement employs water, which is otherwise discharged from the engine as a "telltale," to provide the means for effecting pumping of the engine housing and for discharging the water from the housing. It is common in marine propulsion devices to provide a small tube or conduit having one end connected to a cooling passage of the engine and having an opposite end extending through an opening in the engine housing or in the lower propulsion unit 12 such that water discharged through that tube is visible to the operator. The flow of water through the tube functions to provide a signal to the operator that the water pump is functioning. The arrangement provided by the present invention functions not only to provide such a "telltale," but is further employed in combination with the siphon arrangement to provide for continual pumping of the engine housing.

Various features of the invention are set forth in the following claims.

We claim:

1. A marine propulsion device comprising an engine having cooling passages and a water pump for forcing cooling water through said cooling passages to cool said engine, a lower unit extending downwardly from said engine, a propeller supported by said lower unit and rotatably driven by said engine, a housing surrounding said engine and including a portion defining a chamber which may collect water, siphon means for removing water from said chamber, said siphon means including a siphon conduit having an inlet end positioned in said chamber, and said siphon conduit including a discharge end projecting from said housing for discharging water from said chamber, and means for generating water flow through said siphon conduit from said inlet end and toward said siphon conduit discharge end, said means for generating water flow including means connected to said water pump for forcing water into said siphon conduit and toward said discharge end.

2. A marine propulsion device as set forth in claim 1, and wherein said water pump includes an outlet port connected to said cooling passages and wherein said means for generating water flow through said conduit includes a supply conduit having opposite ends, one of said ends of said supply conduit being connected to said cooling passages said other of said opposite end of said supply conduit being connected to said siphon conduit so as to force water from said cooling passages into said siphon conduit toward said discharge end.

3. A marine propulsion device as set forth in claim 2 wherein said end of said supply conduit joined to said siphon conduit intersects said siphon conduit at an acute angle and forces water downwardly into said siphon conduit in said direction of said discharge end of said siphon conduit.

4. A marine propulsion device as set forth in claim 1 wherein said housing includes a bottom wall, wherein said inlet end is positioned in said chamber adjacent to said bottom wall of said housing, and wherein said discharge end extends through said bottom wall and is below said inlet end.

5. A marine propulsion device comprising an engine having cooling passages and a water pump for forcing cooling water through said cooling passages to cool said engine, a lower unit extending downwardly from said engine, a propeller supported by said lower unit and rotatably driven by said engine, a housing surrounding said engine and including a portion defining a chamber which may collect water, siphon means for removing water from said chamber, said siphon means including a siphon conduit having a first conduit portion, said first conduit portion having an upper end and a lower end housed in said chamber, and a second conduit portion having an upper end and a lower end, said upper ends of said first and second conduit portions being joined, and said lower end of said second conduit portion projecting from said housing for discharging water from said chamber, and means for generating water flow through said siphon conduit from said chamber and toward said second conduit portion lower end, said means for generating water flow including means connected to said water pump for forcing water into said siphon conduit and toward said second conduit portion lower end.

6. A marine propulsion device as set forth in claim 5, and wherein said water pump includes an outlet port connect to said cooling passages and wherein said means for generating water flow though said siphon conduit includes a supply conduit including opposite ends, one of said ends of said supply conduit being connected to said cooling passages and said other of said opposite ends of said supply conduit being connected to said siphon conduit so as to force water from said second outlet into said siphon conduit toward said lower end of said second conduit portion.

7. A marine propulsion device as set forth in claim 6 wherein said end of said supply conduit joined to said siphon conduit intersects said second conduit portion at an acute angle and forces water downwardly into said second conduit portion in said direction of said lower end of said second conduit portion.

8. A marine propulsion device as set forth in claim 5 wherein said housing includes a bottom wall and wherein said lower end of said first conduit portion is positioned in said chamber adjacent to said bottom wall of said housing and said lower end of said second conduit portion extends through said bottom wall.

9. A marine propulsion device comprising an engine having cooling passages and a water pump for forcing cooling water through said cooling passages to cool said engine, a lower unit extending downwardly from said engine, a propeller supported by said lower unit and rotatably driven by said engine, a housing surrounding said engine and including a portion defining a chamber which may collect water, means for bleeding water from said cooling passages and for discharging water from said engine so as to provide a signal that said water pump is operating, said means for bleeding including a bleed conduit having one end connected to said cooling passages and an opposite end outside said engine housing, and siphon means for removing water from said chamber, said siphon means including a siphon conduit having an inlet end positioned in said chamber, and said siphon conduit being connected to said bleed conduit.

* * * * *